US010883682B1

(12) United States Patent
Guo et al.

(10) Patent No.: US 10,883,682 B1
(45) Date of Patent: Jan. 5, 2021

(54) LIGHTING FIXTURES HAVING MOUNTING STRUCTURE OPENINGS AND COVERINGS

(71) Applicant: FintronX, LLC, Raleigh, NC (US)

(72) Inventors: Xiaobo Guo, Raleigh, NC (US); G. Patrick Forbis, Raleigh, NC (US); Eric Lucas, Raleigh, NC (US)

(73) Assignee: FintronX, LLC, Raleigh, NC (US)

( * ) Notice: Subject to any disclaimer, the term of this patent is extended or adjusted under 35 U.S.C. 154(b) by 0 days.

(21) Appl. No.: 16/824,947

(22) Filed: Mar. 20, 2020

(51) Int. Cl.

| | |
|---|---|
| ***F21S 8/04*** | (2006.01) |
| ***F21V 15/01*** | (2006.01) |
| ***F21V 23/02*** | (2006.01) |
| ***F21V 23/06*** | (2006.01) |
| ***F21V 23/00*** | (2015.01) |
| ***F21V 7/00*** | (2006.01) |
| *F21Y 115/10* | (2016.01) |

(52) U.S. Cl.
CPC ..... *F21S 8/043* (2013.01); *F21S 8/046* (2013.01); *F21V 7/00* (2013.01); *F21V 15/01* (2013.01); *F21V 23/001* (2013.01); *F21V 23/02* (2013.01); *F21V 23/06* (2013.01); *F21Y 2115/10* (2016.08)

(58) Field of Classification Search
CPC ..... F21V 23/007–009; F21V 15/00–04; F21S 8/04–046; F21K 9/20; F21K 9/278
See application file for complete search history.

(56) References Cited

U.S. PATENT DOCUMENTS

| | | | | |
|---|---|---|---|---|
| 8,092,037 | B2 * | 1/2012 | Kassay | F21S 8/06 362/217.05 |
| 8,727,566 | B1 * | 5/2014 | Szeto | F21S 8/026 29/825 |
| 8,789,966 | B2 | 7/2014 | McCanless et al. | |
| 9,322,518 | B1 * | 4/2016 | Steedly | F16B 1/00 |
| 9,822,937 | B2 * | 11/2017 | McCane | F21K 9/90 |
| 9,851,090 | B2 * | 12/2017 | Scribante | F21V 23/06 |
| 10,288,240 | B2 * | 5/2019 | Szeto | F21V 23/023 |
| 2012/0268922 | A1 * | 10/2012 | Jin | F21V 17/18 362/157 |
| 2013/0294059 | A1 * | 11/2013 | Galluccio | F21V 7/0008 362/218 |
| 2014/0168961 | A1 * | 6/2014 | Dubord | F21V 7/0016 362/225 |
| 2016/0033088 | A1 * | 2/2016 | Mayfield, III | F21K 9/90 362/225 |
| 2019/0137058 | A1 * | 5/2019 | Ye | F21V 21/02 |

* cited by examiner

*Primary Examiner* — Mariceli Santiago
(74) *Attorney, Agent, or Firm* — Olive Law Group, PLLC

(57) ABSTRACT

Lighting fixtures having mounting structure openings and coverings are disclosed. According to an aspect, a lighting fixture includes a housing defining space for holding an electronic component for distributing power to one or more light sources. The lighting fixture also includes a mounting structure attached to the housing and configured to at least partially enclose the space for containing the electronic component. The mounting structure defines an opening for accessing the electronic component. Further, the mounting structure is configured to attach to light source(s). The lighting fixture also includes a covering attached to the mounting structure and arranged to cover the opening when attached.

16 Claims, 6 Drawing Sheets

LIGHTING FIXTURES HAVING MOUNTING STRUCTURE OPENINGS AND COVERINGS

TECHNICAL FIELD

The presently disclosed subject matter relates generally to lighting. Particularly, the presently disclosed subject matter relates to lighting fixtures having mounting structure openings and coverings.

BACKGROUND

In interior spaces, lighting fixtures are often attached to ceilings or otherwise overhead such that its light source can direct light downward towards the floor, a living space, or a workspace. Lighting fixtures typically include light sources such as a fluorescent lamp or more recently light emitting diodes (LED). Oftentimes, the light source will be covered by some type of lens in order to spread the generated light.

An electrical ballast is often placed in a lighting fixture and used to limit current applied to the fixture's light source. The electrical ballast is frequently positioned in a space behind the light source so that it does not block light output by the light source. Also such placement makes it more convenient for wiring the electrical ballast to a source of power.

Electrical ballasts can frequently fail and need replacement. In such cases where the lighting fixture is placed high overhead, there is a significant benefit to making access and replacement of the electrical ballast convenient to a technician. For example, in some cases such as warehouses or poultry houses, the lighting fixture can be greater than 20 feet above floor. In these cases, technicians may be required to use a ladder to get near the lighting fixture for replacement of the electrical ballast. Therefore, it is desired to minimize the time needed to replace the electrical ballast.

BRIEF DESCRIPTION OF THE DRAWINGS

Figure 1:
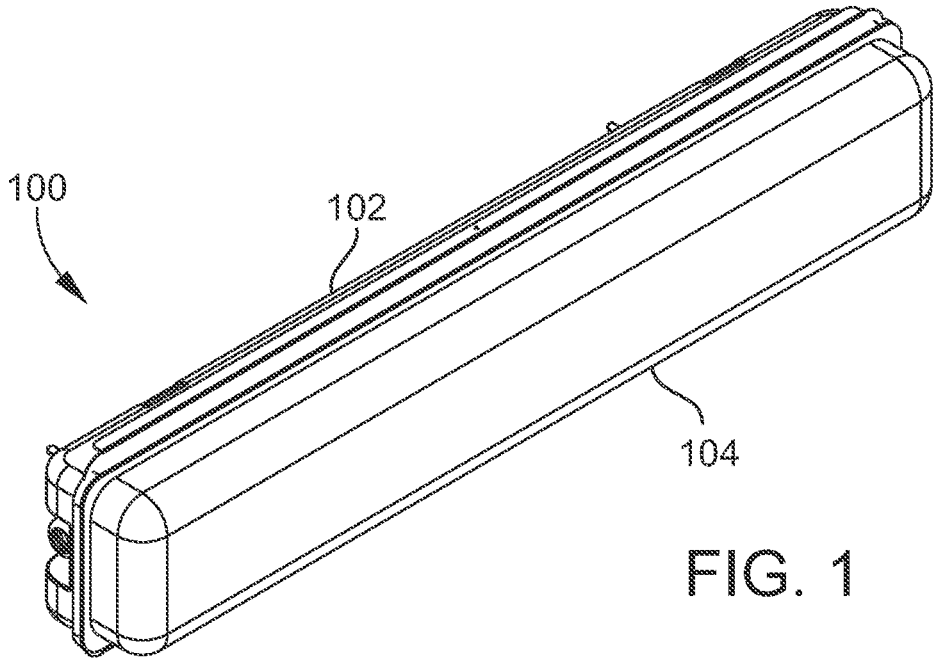
Figure 2:
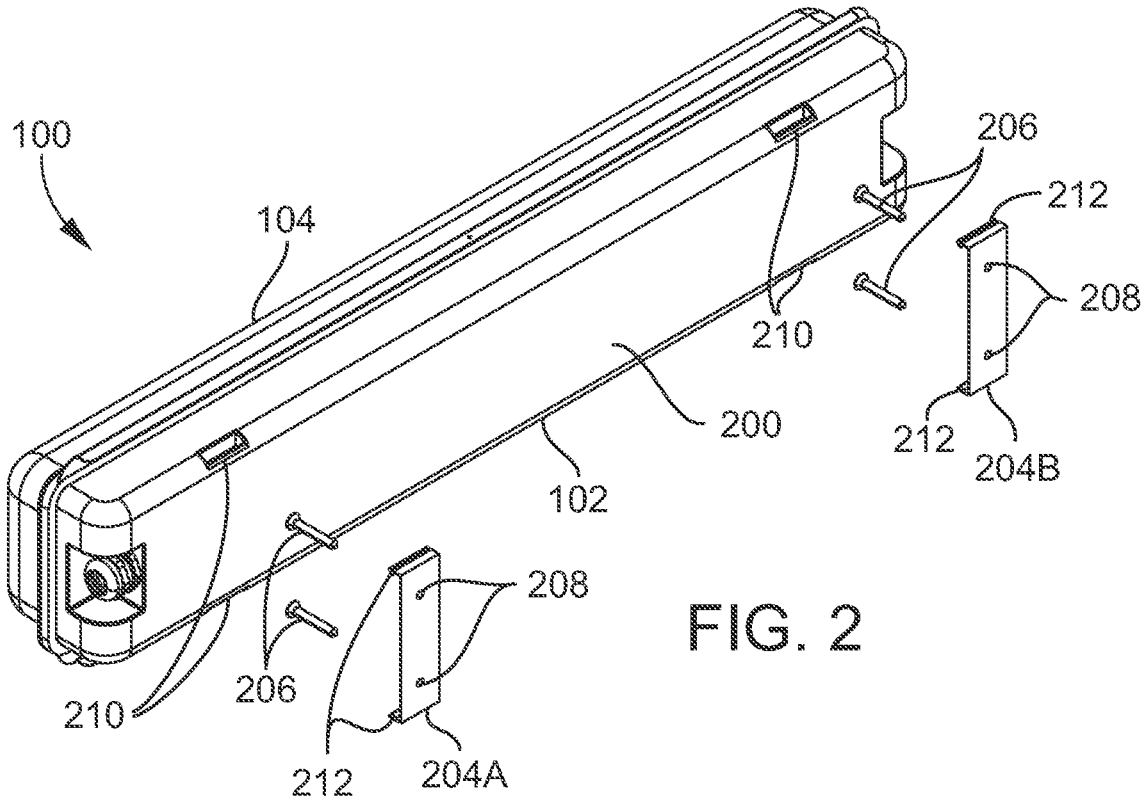
Figure 3:
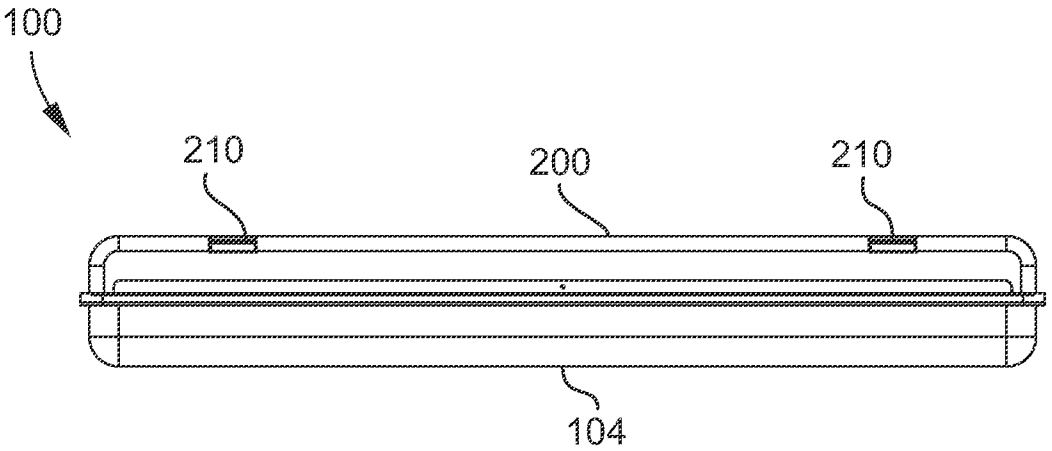
Figure 5:
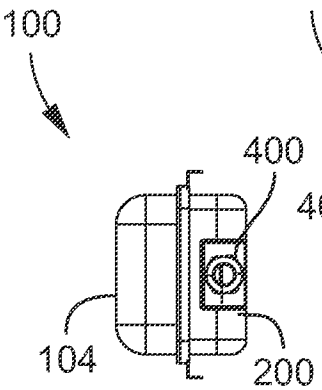
Figure 6:
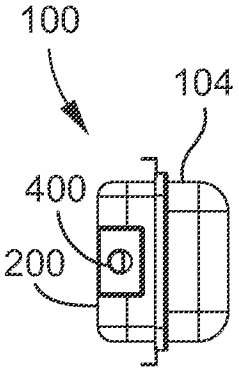
Figure 7:
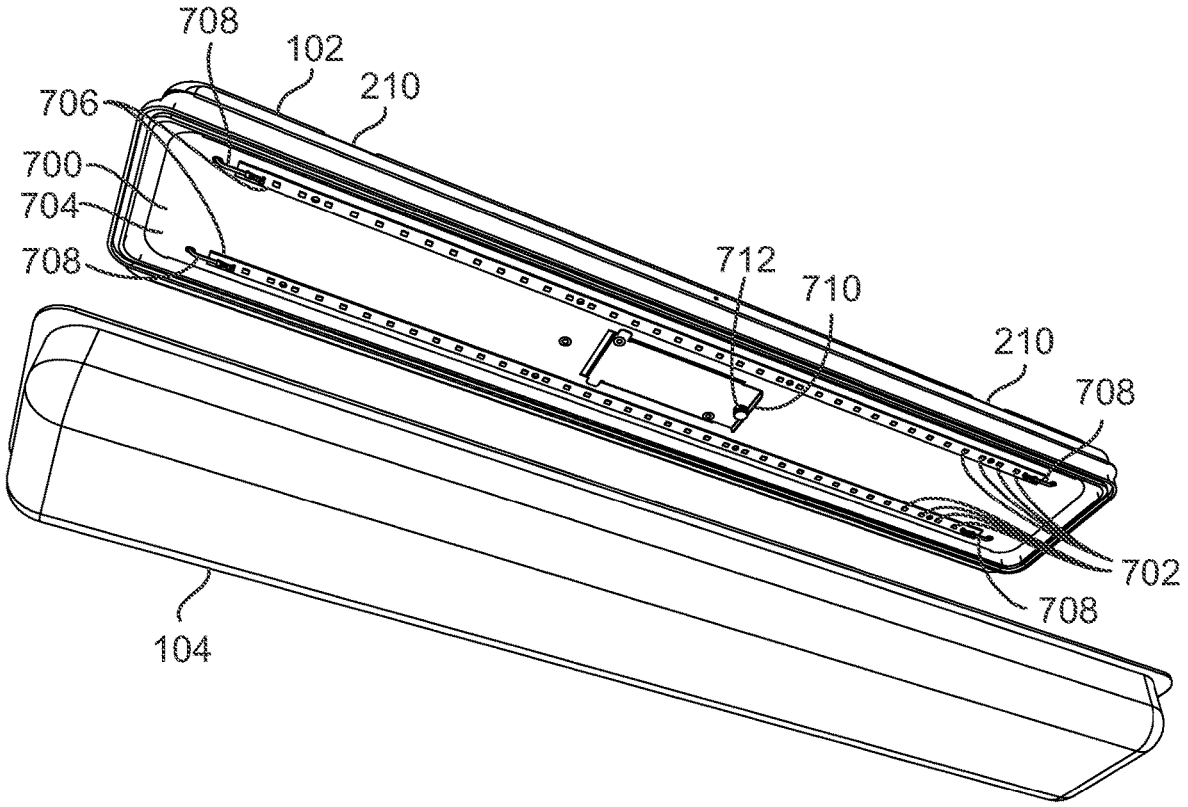
Figure 8:
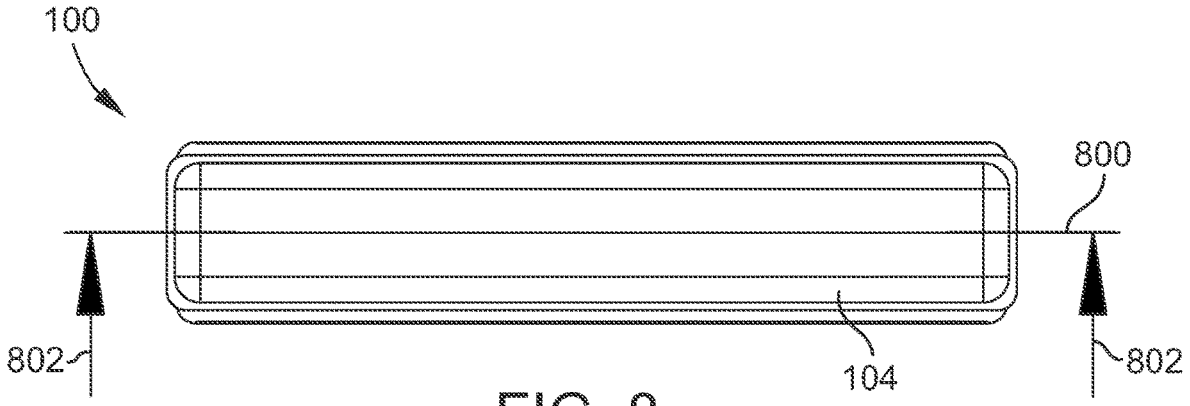
Figure 9:
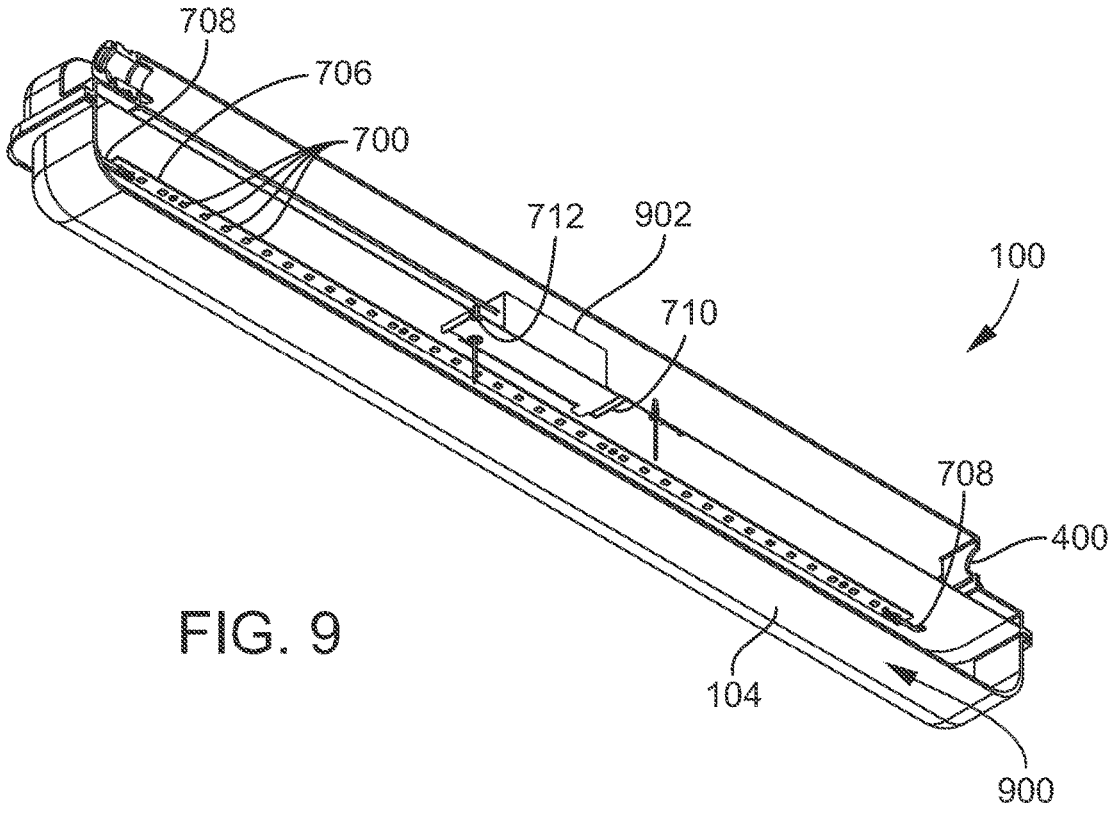
Figure 10:
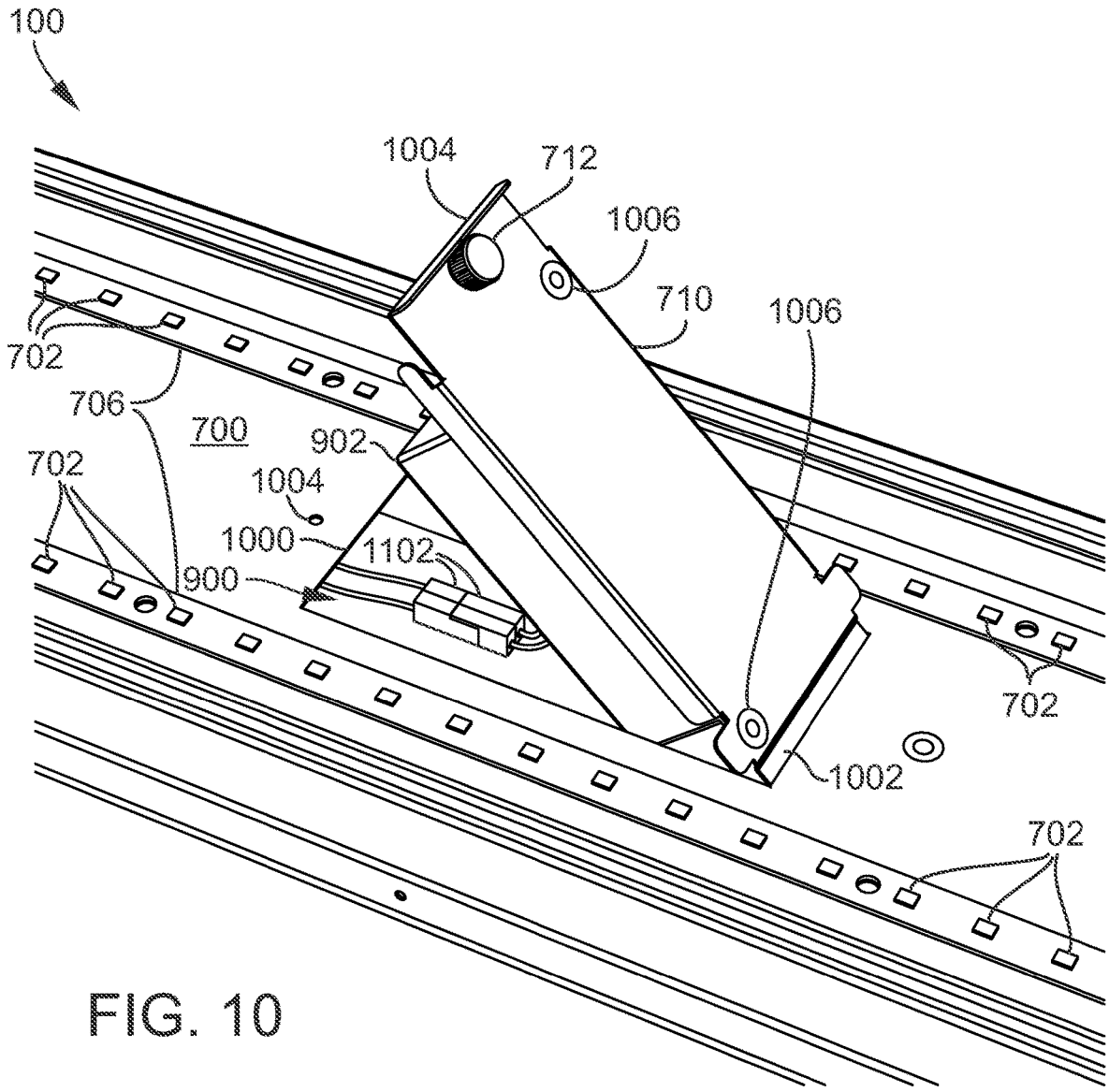
Figure 11:
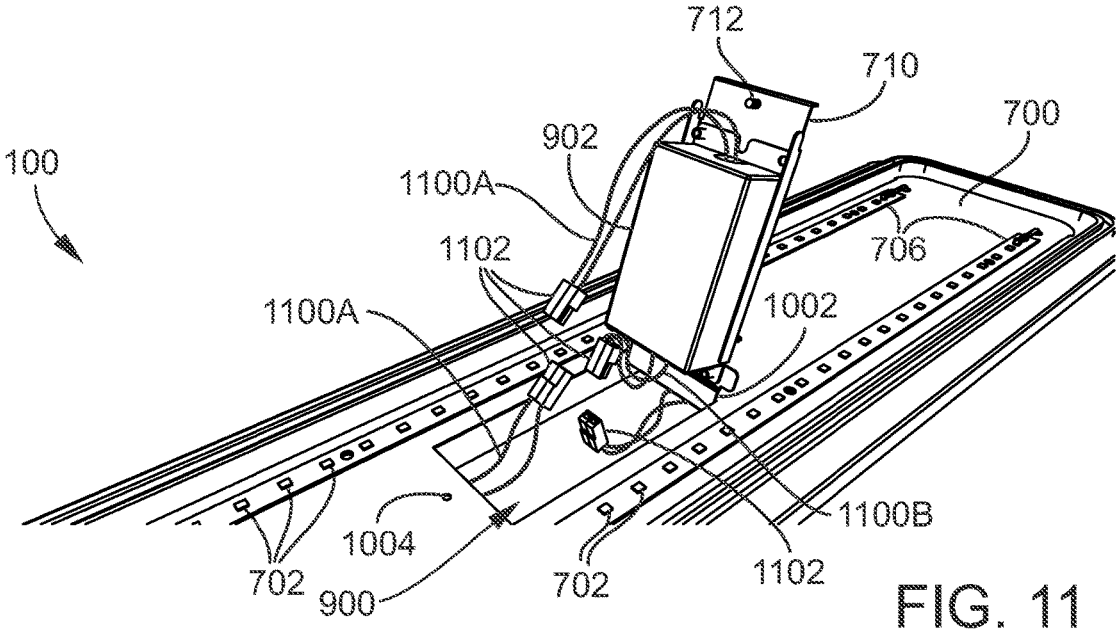
Figure 12:
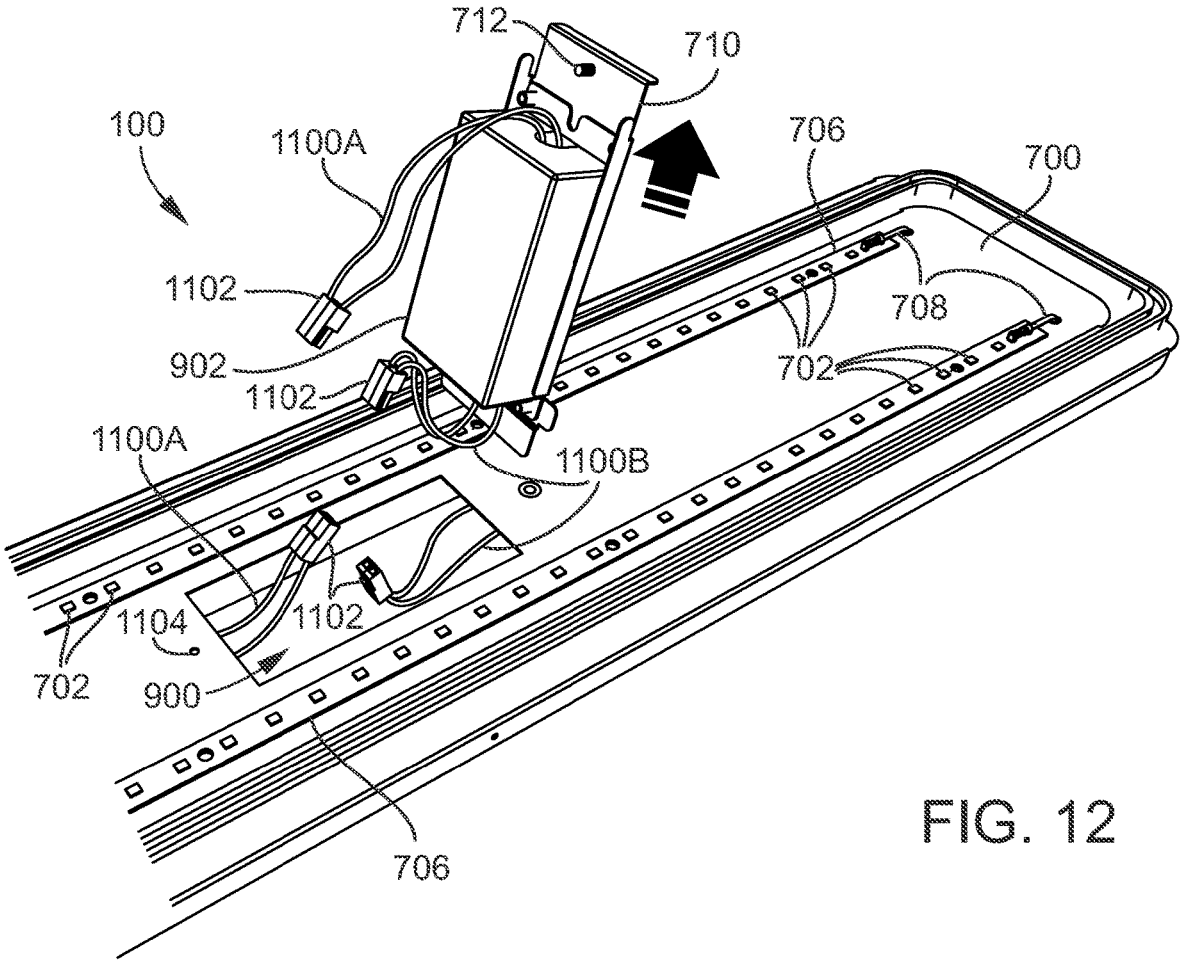

Having thus described the presently disclosed subject matter in general terms, reference will now be made to the accompanying Drawings, which are not necessarily drawn to scale, and wherein:

FIG. 1 is a bottom perspective view of a lighting fixture in accordance with embodiments of the present disclosure;

FIG. 2 a top perspective view of the lighting fixture shown in FIG. 1;

FIGS. 3, 4, 5, and 6 are a side view, a top view, an end view, and an opposing end view, respectively, of the lighting fixture shown in FIGS. 1 and 2;

FIG. 7 is a bottom perspective showing the lighting fixture of FIGS. 1-6 with the lens assembly detached and separated from the housing;

FIG. 8 is a bottom view of the lighting fixture shown in FIGS. 1-7;

FIG. 9 is a cross-sectional, perspective side view of the lighting fixture 100 shown in FIGS. 1-8; and FIGS. 10-12 are zoomed-in, perspective views of lighting fixture shown in FIGS. 1-9 with different representative steps depicting the covering being opened and removed for accessing the interior of the housing and electrical ballast.

SUMMARY

The presently disclosed subject matter relates to lighting fixtures having mounting structure openings and coverings. According to an aspect, a lighting fixture includes a housing defining space for holding an electronic component for distributing power to one or more light sources. The lighting fixture also includes a mounting structure attached to the housing and configured to at least partially enclose the space for containing the electronic component. The mounting structure defines an opening for accessing the electronic component. Further, the mounting structure is configured to attach to light source(s). The lighting fixture also includes a covering attached to the mounting structure and arranged to cover the opening when attached.

DETAILED DESCRIPTION

The following detailed description is made with reference to the figures. Exemplary embodiments are described to illustrate the disclosure, not to limit its scope, which is defined by the claims. Those of ordinary skill in the art will recognize a number of equivalent variations in the description that follows.

Articles "a" and "an" are used herein to refer to one or to more than one (i.e. at least one) of the grammatical object of the article. By way of example, "an element" means at least one element and can include more than one element.

"About" is used to provide flexibility to a numerical endpoint by providing that a given value may be "slightly above" or "slightly below" the endpoint without affecting the desired result.

The use herein of the terms "including," "comprising," or "having," and variations thereof is meant to encompass the elements listed thereafter and equivalents thereof as well as additional elements. Embodiments recited as "including," "comprising," or "having" certain elements are also contemplated as "consisting essentially of" and "consisting" of those certain elements.

Recitation of ranges of values herein are merely intended to serve as a shorthand method of referring individually to each separate value falling within the range, unless otherwise indicated herein, and each separate value is incorporated into the specification as if it were individually recited herein. For example, if a range is stated as between 1%-50%, it is intended that values such as between 2%-40%, 10%-30%, or 1%-3%, etc. are expressly enumerated in this specification. These are only examples of what is specifically intended, and all possible combinations of numerical values between and including the lowest value and the highest value enumerated are to be considered to be expressly stated in this disclosure.

Unless otherwise defined, all technical terms used herein have the same meaning as commonly understood by one of ordinary skill in the art to which this disclosure belongs.

FIG. 1 illustrates a bottom perspective view of a lighting fixture 100 in accordance with embodiments of the present disclosure. Referring to FIG. 1, the lighting fixture 100 includes a housing 102 for holding an electrical ballast and/or other electronic components for distributing power to one or more light sources. Further, the lighting fixture 100 includes a lens assembly 104 configured to disperse light generated by the light source(s). In this example, the housing 102 and the lens assembly 104, when assembled together as shown, are elongated and cuboidal in shape, although it should be noted that the housing 102 and the lens assembly 104 may alternatively be any other suitable dimension and shape, and made of any suitable material such as a transparent or semi-transparent polymer material or glass.

FIG. 2 illustrates a top perspective view of the lighting fixture 100 shown in FIG. 1. Referring to FIG. 2, the figure shows a side 200 of the housing 102 configured for attachment to a ceiling or other overhead structure suitable to hold the light fixture 100. Particularly, the side 200 has a shape defined for attaching to a bracket assembly, generally designated 202, and shown apart from the side 200 for ease of view. The bracket assembly 202 includes two brackets 204A and 204B. Each of the brackets 204A and 204B have a respective pair of bolts 206 and corresponding apertures 208 through which the bolts 206 may be placed for affixing the brackets 204A and 204B to the ceiling or other suitable structure. The housing 102 has two pairs of indentations 210 for gripping by the brackets 204A and 204B for holding of the housing 102 by the brackets 204A and 204B. Particularly, the brackets 204A and 204B are flexible and have ends 212 configured to hold onto the indentations 210. The bracket assembly 202 is an example of one mechanism for affixing the lighting fixture 100 to a ceiling or other overhead structure; however, it should be understood that any other suitable mechanism may be used.

Figure 4:
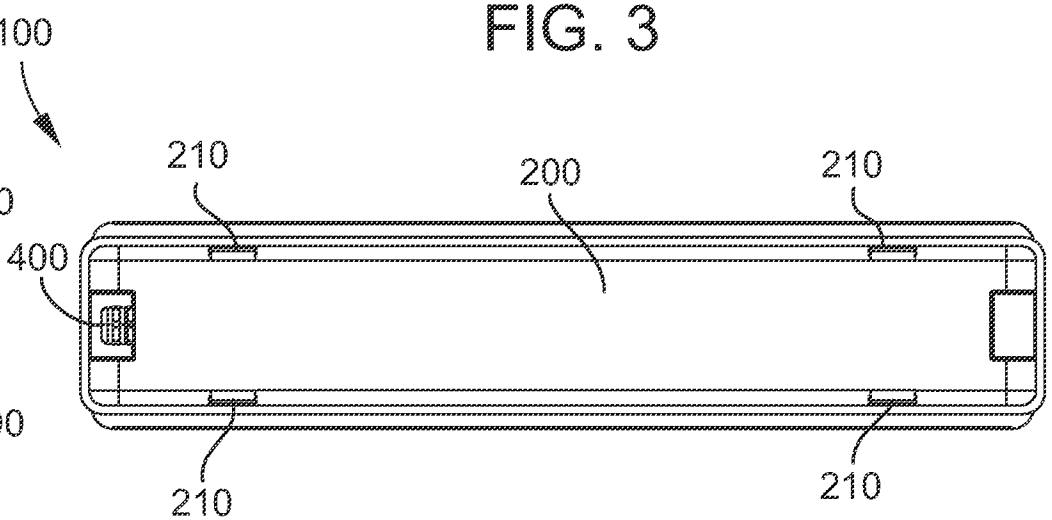

FIGS. 3, 4, 5, and 6 illustrate a side view, a top view, an end view, and an opposing end view, respectively, of the lighting fixture 100 shown in FIGS. 1 and 2. Referring to FIGS. 4-6, the lighting fixture 100 includes an opening 400 for receiving electrical wires (not shown) for powering the light sources of the lighting fixture 100.

FIG. 7 illustrates a bottom perspective showing the lighting fixture 100 of FIGS. 1-6 with the lens assembly 104 detached and separated from the housing 102. Referring to FIG. 7, the figure shows that the lighting fixture 100 includes a mounting structure 700 attached to the housing 102. The mounting structure 700 is affixed to the housing 102 and includes multiple LEDs 702 attached to a side 704 thereof. In this example, the light sources of the lighting fixture 100 are LEDs 702; however, it should be understood that the light source(s) may be an alternate suitable light source, such as a fluorescent lamp or light. Further, in this example, the LEDs 702 include two strips 706 of LEDs that extend along a length of the mounting structure 700. Each strip 706 is operably connected to electrical wires 708 for powering the LEDs 702. The electrical wires 708 extend through apertures into an interior space (not shown) of the housing 102.

With continuing reference to FIG. 7, a covering 710 is attached to the mounting structure 700 in a closed position for covering an opening (now shown in this figure) of the mounting structure 700. A screw 712 may part of a screw assembly that can be tightened to attach the covering 710 to the mounting structure 700 as shown. In this example, the screw 712 is a thumb screw but may alternatively be any other suitable type of screw.

FIGS. 8 and 9 illustrate a bottom view and a cross-sectional, perspective side view, respectively, of the lighting fixture 100 shown in FIGS. 1-7. Referring to FIG. 8, line 800 and arrows 802 show the location of the cross-sectional view of FIG. 9. Referring to FIG. 9, it is shown that the housing 102 defines a space 900 that can hold one or more electronic components, such as electrical wires (not shown) an electrical ballast 902. The electrical ballast 902 can be suitably connected to and operable with the LEDs 702 for distributing power to the LEDs 702.

FIGS. 10-12 illustrate zoomed-in, perspective views of lighting fixture 100 shown in FIGS. 1-9 with different representative steps depicting the covering 710 being opened and removed for accessing the interior 900 of the housing 102 and electrical ballast 902. Referring initially to FIG. 10, the lens assembly 104 (shown in FIG. 7 for example) has been removed such that the covering 710 can be accessed for opening. The interior 900 can be accessed through an opening 1000 defined in the mounting structure 700. The covering 710 includes a hinge 1002 at an end. The hinge 1002 is connected to and operable with the mounting structure 700 to permit the covering 710 to pivot at the hinge 1002 between an open position (shown in FIGS. 10 and 11) and a closed position (shown in FIG. 7). In the closed position, the covering 710 covers the opening 1000. In the open position, the covering 710 is at least partially distanced from the opening to permit access through the opening 1000 into the space 900. At an end that opposes the hinge, the screw 712 can attach that end to the mounting structure 700. Particularly, the screw 712 may be screwed into a suitable opening 1004 defined by the mounting structure to secure the covering 710 in the closed position.

Now turning to FIG. 11, this figure shows the covering 710 at an open position further from the opening 1000 such that the electrical ballast 902 and other components in the space 900 can be more easily accessed by a technician. The electrical ballast 902 has two sets of electrical wires 1100A and 1100B for electrically connecting to a power source (not shown) and the LEDs 702, respectively. In this way, the LEDs 702 can be suitably powered, and the electrical ballast 902 can suitably condition electrical power to the LEDs 702 by limiting the current applied to the LEDs 702.

In embodiments, the wires 1100A and 1100B each include electrical quick-disconnect couplers 1102 for electrical connection and disconnection of the electrical ballast 902 to the power source and LEDs 702. FIG. 10 shows a pair of couplers 1102 connected together. FIGS. 11 and 12 each show couplers 1102 being disconnected Further, FIG. 12 shows that the covering 710 is removably attached to the mounting structure 700. For example, once the covering 710 is pivoted to a particular extent as shown in FIG. 12, the end with the hinge 1002 can release from the mounting structure 700 such that the covering 710 can be removed from the mounting structure 700. Further, as shown in FIG. 12, the covering 710 along with the electrical ballast 902 can be completely removed due to detachment of the couplers 1102 for ease of handling and replacement of the electrical ballast 902. In this example, the electrical ballast 902 can be removed from the covering 710 by unscrewing a pair of screw assemblies 1006 as shown in FIG. 10.

While the embodiments have been described in connection with the various embodiments of the various figures, it is to be understood that other similar embodiments may be used, or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed is:

1. A lighting fixture comprising:

a housing defining space for holding an electrical ballast for distributing power to one or more light sources, wherein the electrical ballast is configured to limit current applied to the one or more light sources;

a mounting structure attached to the housing and configured to at least partially enclose the space for containing the electrical ballast, the mounting structure defining an opening for accessing the electrical ballast, wherein the mounting structure is configured to attach to the one or more light sources;

a covering attached to the mounting structure and arranged to cover the opening when attached, wherein the covering comprises a hinge at an end, the hinge being connected to and operable with the mounting structure to permit the covering to pivot at the hinge between an open position and a close position, wherein in the closed position, the covering covers the opening, and wherein in the open position, the covering is at least partially distanced from the opening to permit access through the opening into the space defined by the housing;

an attachment mechanism configured to attach the covering to the mounting structure in the closed position;

an electrical quick-disconnect coupler configured to electrical connect and disconnect the electrical ballast from the at least one electrical wire; and a screw assembly that attaches the electrical ballast to the covering.

2. The lighting fixture of claim 1, wherein the housing comprises a base having a first side and a second side that opposes the first side, wherein the first side defines a portion of the space, and wherein the second side is configured for attachment to a ceiling.

3. The lighting fixture of claim 2, further comprising at least one bracket configured to interface with the second side for attaching to the ceiling.

4. The lighting fixture of claim 1, wherein the housing comprises a base and at least two sides that extend from the base to form at least two ends, and wherein the mounting structure is attached to the at least two ends.

5. The lighting fixture of claim 1, wherein the mounting structure defines a first side and a second side, wherein the first side at least partially defines the space for containing the electrical ballast, and wherein the second side is at least partially reflective for reflecting light generated by the one or more light sources.

6. The lighting fixture of claim 1, wherein the covering is removably attached to the mounting structure.

7. The lighting fixture of claim 1, wherein the electrical ballast is removably attached to the covering.

8. The lighting fixture of claim 7, further comprising a screw assembly that attaches the electrical ballast to the covering.

9. The lighting fixture of claim 1, wherein the attachment mechanism comprises a screw.

10. The lighting fixture of claim 9, wherein the screw is a thumb screw.

11. The lighting fixture of claim 1, wherein the one or more light sources comprise light emitting diodes (LEDs).

12. The lighting fixture of claim 11, wherein the LEDs comprise at least one strip of LEDs extending along a length of the mounting structure.

13. The lighting fixture of claim 1, further comprising a lens assembly configured to define a space to contain the one or more light sources and to disperse light generated by the one or more light sources.

14. The lighting fixture of claim 13, further comprising at least one latch configured to releasably attach lens assembly to one of the housing and the mounting structure.

15. The lighting fixture of claim 13, wherein the lens assembly is configured to be sealingly attached to the one of the housing and the mounting structure for environmentally protecting the one or more light sources.

16. The lighting fixture of claim 1, further comprising at least one electrical wire connected to the electrical ballast at one end.

* * * * *